US009831024B2

(12) United States Patent
Friedemann et al.

(10) Patent No.: US 9,831,024 B2
(45) Date of Patent: Nov. 28, 2017

(54) METHOD AND DEVICE FOR THE REDUCTION OF FLASHOVER-RELATED TRANSIENT ELECTRICAL SIGNALS BETWEEN THE ACCELERATION SECTION OF AN X-RAY TUBE AND A HIGH-VOLTAGE SOURCE

(71) Applicant: GE Sensing & Inspection Technologies GmbH, Hurth (DE)

(72) Inventors: Reinhard Friedemann, Wunstorf (DE); Andreas Schmitt, Wunstorf (DE); Farid Aslami, Wunstorf (DE); Florian Goellner, Wunstorf (DE)

(73) Assignee: GE SENSING & INSPECTION TECHNOLOGIES GMBH, Hurth (DE)

( * ) Notice: Subject to any disclaimer, the term of this patent is extended or adjusted under 35 U.S.C. 154(b) by 54 days.

(21) Appl. No.: 14/927,538

(22) Filed: Oct. 30, 2015

(65) Prior Publication Data

US 2016/0126054 A1 May 5, 2016

(30) Foreign Application Priority Data

Oct. 31, 2014 (DE) ..... 10 2014 015 974

(51) Int. Cl.
*H01F 17/06* (2006.01)
*H01R 13/719* (2011.01)
*H05G 1/08* (2006.01)

(52) U.S. Cl.
CPC ..... *H01F 17/06* (2013.01); *H01F 2017/065* (2013.01); *H01R 13/719* (2013.01); *H05G 1/08* (2013.01)

(58) Field of Classification Search
None
See application file for complete search history.

(56) References Cited

U.S. PATENT DOCUMENTS 4,076,608 A * 2/1978 Fujishiro ..... G01N 27/4073 174/74 R
4,268,105 A * 5/1981 Widmayer ..... H05K 9/0066 333/182

(Continued)

FOREIGN PATENT DOCUMENTS

DE 8807359 U1 10/1989
DE 3929402 A1 3/1991
DE 4138889 A1 8/1992

OTHER PUBLICATIONS

Unofficial translation of Search Report dated Jun. 26, 2015 in relation to corresponding DE Application 102014015974.4.

*Primary Examiner* — Chau N Nguyen
*Assistant Examiner* — Muhammed Azam
(74) *Attorney, Agent, or Firm* — COOPER LEGAL GROUP LLC

(57) ABSTRACT

A high-voltage resistant cable for connecting a high-voltage source and an acceleration section of an X-ray tube that each have a respective socket and a flange. The cable includes an inner conductor, a surrounding electrical insulator, an enveloping shielding made of an electrically conductive material, and plugs at each respective end. Each plug includes a plug flange for cooperating with the respective flange and having a hollow interior, and an electrical insulator that includes a conic-shape portion for extending into the respective socket, and a cylindrical portion extending within the hollow interior of the plug flange. The cable including absorber elements at each of the two ends of the cable for absorbing the energy of high-voltage discharge-related transients. Each absorber element is configured as a ring-shape, the ring-shape absorber element encircling the cylindrical portion and being located within the hollow interior of the plug flange.

18 Claims, 5 Drawing Sheets

(56) References Cited

U.S. PATENT DOCUMENTS 4,768,215 A * 8/1988 Kiwaki ..... H05G 1/265 174/85
4,819,260 A * 4/1989 Haberrecker ..... H01J 35/14 378/137
4,972,459 A * 11/1990 Sommer ..... H05G 1/08 333/12
5,093,853 A * 3/1992 Licht ..... H05G 1/08 378/101
5,250,755 A * 10/1993 Dinzen ..... H01B 7/0054 174/102 SC
5,268,955 A * 12/1993 Burke ..... H01J 35/045 378/101
5,696,808 A * 12/1997 Lenz ..... H05G 1/06 378/101
6,369,318 B1 * 4/2002 Uchida ..... G06F 1/182 174/36
6,395,388 B1 * 5/2002 Iwasaki ..... B82Y 10/00 257/E43.004
6,418,191 B1 * 7/2002 Fehre ..... H05G 1/20 362/21
6,507,641 B1 * 1/2003 Kondo ..... G03F 7/70033 378/119
7,110,499 B2 * 9/2006 Beyerlein ..... H05G 1/54 378/101
7,936,544 B2 * 5/2011 Beland ..... H02M 1/088 361/58
2001/0048732 A1 * 12/2001 Wilson ..... A61B 6/06 378/21
2002/0084094 A1 * 7/2002 DeForest, Jr. ..... H01R 13/53 174/75 C
2002/0110219 A1 * 8/2002 Yagi ..... H05G 1/54 378/118
2003/0223546 A1 * 12/2003 McGregor ..... H05G 2/003 378/143
2004/0114724 A1 * 6/2004 Subraya ..... H01J 35/18 378/141
2004/0190682 A1 * 9/2004 Deuringer ..... H05G 1/52 378/137
2004/0208287 A1 * 10/2004 Deuringer ..... H05G 1/52 378/121
2004/0223588 A1 * 11/2004 Subraya ..... H01J 35/18 378/141
2005/0069087 A1 * 3/2005 Kendall ..... H05G 1/04 378/119
2005/0100133 A1 * 5/2005 Reinhold ..... H05G 1/46 378/138
2005/0232395 A1 * 10/2005 Smith ..... H01R 13/53 378/121
2006/0084315 A1 * 4/2006 Brodersen ..... H01J 35/165 439/470
2008/0041612 A1 * 2/2008 Negle ..... H05G 1/02 174/138 G
2008/0285716 A1 * 11/2008 Tang ..... H05G 1/10 378/112
2011/0170666 A1 * 7/2011 Chen ..... G01N 23/223 378/84
2012/0208386 A1 * 8/2012 Beuster ..... H01R 13/53 439/283
2013/0177137 A1 * 7/2013 Eichhorn ..... H01J 35/16 378/101
2014/0272452 A1 * 9/2014 Kamidaki ..... H01B 7/30 428/611
2015/0124936 A1 * 5/2015 Anno ..... H01J 35/101 378/130
2015/0187462 A1 * 7/2015 Kondo ..... H01R 4/023 310/71
2015/0208519 A1 * 7/2015 Kawai ..... H01F 27/02 336/90

* cited by examiner

METHOD AND DEVICE FOR THE REDUCTION OF FLASHOVER-RELATED TRANSIENT ELECTRICAL SIGNALS BETWEEN THE ACCELERATION SECTION OF AN X-RAY TUBE AND A HIGH-VOLTAGE SOURCE

BACKGROUND

Embodiments of the present invention relates to the field of high-voltage engineering, in particular to supplying the high voltage required for operation to an X-ray tube. In particular, embodiments of the present invention relates to the non-destructive material testing by means of X-radiation, which can be generated, in particular, by means of microfocus X-ray tubes. In particular, the invention further relates to the electrically conductive connection between a high-voltage source and the acceleration section of an X-ray tube, in particular a microfocus X-ray tube, for applying the required accelerating voltage, which is typically between 50 and 350 kV in the field of material testing, to the acceleration section of the X-ray tube. In particular, the invention further relates to a high-voltage resistant cable for connecting a high-voltage source with the acceleration section of an X-ray tube, an equally high-voltage resistant plug as well as an equally high-voltage resistant socket. Further, it relates to a high-voltage resistant plug-and-socket combination, a high-voltage resistant connecting cable and an use of the aforementioned components. Finally, embodiments of the present invention relate to a testing assembly comprising an X-ray tube and a high-voltage source and to a method for reducing flashover-related damage during the operation of such an assembly.

The use of X-radiation for non-destructive material testing has been known for a long time in the prior art. The methods commonly used at the time this application was filed are generally transmission methods in which a shadow of the test object to be inspected is generated. The point of incidence of a high-energy electron beam on an anode serves as the X-ray source. This focal spot constitutes an approximately point-shaped source of X-radiation. The anode is generally a target of a suitable metal, such as copper or tungsten, for example, which can be cooled and, if necessary, also be configured to be movable, in particular rotatable. Basically, two types of X-ray tubes are commonly used in material testing. On the one hand, rotating anode tubes in which a rotatably mounted anode plate is disposed in an evacuated and sealed-off glass container are often used. Due to mechanical tolerances of the mounting of the anode, which were so far impossible to avoid, a movement of the focal point on the rotating anode inevitably occurs during the rotation of the rotating anode. This movement of the X-ray source relative to the stationary test object constitutes a substantial limitation of the resolution attainable by means of such a rotating anode tube.

A significant improvement of the resolution can be obtained with so-called microfocus X-ray tubes, which gained currency in recent years in the field of non-destructive material testing. Generally, microfocus X-ray tubes are characterized by a stationary target on which a highly focused electron beam is incident. An electron-optical system such as is known from the field of electron microscopy is used for focusing the electron beam. Due to the high degree of focusing of the electron beam and the fact that the anode is stationary, it is possible to generate an approximately point-shaped focal spot whose position relative to the test object is virtually stationary. Here, relevant positional changes substantially occur only due to vibration and, in particular, thermal drift of the X-ray testing system.

In contrast to fine-focus rotating anode X-ray tubes, microfocus X-ray tubes are generally not accommodated in sealed-off evacuated glass containers, but are rather disposed in a high vacuum-tight housing which can be opened for maintenance purposes, e.g. for replacing the anode material. Returning such a microfocus X-ray tube to operation after opening the high-vacuum housing requires the reestablishment of a high to ultrahigh vacuum. An insufficient vacuum results in the occurrence of flashovers upon application of the high voltage to the acceleration section of the electron beam source. They can also be caused by the occurrence of deposits on surfaces of the current-carrying parts, as they are inevitably present particularly after opening such an X-ray tube. However, deposits on the surfaces of current-carrying parts, which can result in the occurrence of flashovers, generally also arise during operation of a microfocus X-ray tube after a certain operating time. In order to return to operation a microfocus X-ray tube which has been exposed to ambient conditions, it is therefore necessary to carry out an elaborate conditioning process by means of which the current-carrying surfaces of the microfocus X-ray tube are freed from contamination and smoothed. Similar conditioning methods are also applied if deposits resulting in flashovers have formed during operation.

In practice, it is observed that the above-described flashovers between the cathode and the anode of the X-ray tube can lead to transient interference signals that can run from the X-ray tube to the high-voltage source and damage both the high-voltage source as well as the HV connecting cables used for the connection of the high-voltage source with the X-ray tube, because the transient interference signals can be very high-energy. These interference signals must be taken into consideration when designing the high-voltage source and the HV connecting cables used, which results in increased costs. In any case, they constitute an influential factor that is critical for the lifetime of the high-voltage source and electrical HV connecting cables used.

Therefore, attempts are being made in practice to reduce the occurrence of the aforementioned flashovers as far as possible by means of a suitable design of the X-ray tube. In particular, a surface treatment of the current-carrying parts of the X-ray tube has proved its worth in this respect, in which the surface roughness is reduced as far as possible, for example by high-gloss polishing of the metallic parts. In practice, however, this was found to require much effort; in particular, longer-term operation of such an X-ray tube may require an appropriate finishing of surfaces. It was also found in practice that such a surface treatment is not suitable for preventing the occurrence of flashover in principle.

This is where the invention comes in, which has set itself the object of indicating specific measures for effectively protecting the high-voltage source used as well as the HV connecting cable used for connecting the high-voltage source to the X-ray tube against damage from flashover-related transient interference signals.

BRIEF SUMMARY OF THE INVENTION

This object is achieved by a high-voltage resistant cable, by a high-voltage resistant plug, a high-voltage resistant socket, a high-voltage resistant plug-and-socket combination, a high-voltage resistant connecting cable and an use of the aforementioned components. Further, the object is achieved by an assembly and by a method.

In an embodiment, a high-voltage resistant cable is provided for connecting a high-voltage source with the acceleration section of an X-ray tube, in particular an open microfocus X-ray tube. The cable has a, if necessary multi-core, inner conductor surrounded by an electrical insulator. The insulator is a puncture-proof dielectric, with the use of EPR having proved its worth. In particular, the electrical insulator can have a multi-layered structure, for example comprised of an inner layer of semi-conductive EPR, an intermediate layer of electrically insulating EPR and an outer layer, which may again be made of semi-conductive EPR. Further, the cable has a shielding which envelops the inner conductor and the insulator and is made of an electrically conductive material. The use of an alloy made of the constituents copper and tin has proved its worth both for the inner conductor as well as for the shielding.

According to the invention, it is now provided that the cable further comprises an absorber element suitable for absorbing the energy of high-voltage discharge-related transients.

It was found that an absorber element with damping properties can be fabricated from a soft magnetic material. The properties of such an absorber element are particular with regard to the problem to be solved according to the invention if the permeability of the soft magnetic material is above 50, particularly above 500, and more particularly above 1,000. Particular advantages are obtained if the permeability is in the range of 10,000.

In particular, iron in a ferromagnetic crystal structure, cobalt, alloys comprising the constituents nickel and iron, ferritic materials, amorphous metals, nanocrystalline metals and ferrofluids have proved to be suitable soft magnetic materials. Generally, the soft magnetic material used for the absorber element will be present in a solid phase; however, the use of a material which is present in a liquid/fluid phase is also possible. Ferrofluids are mentioned as examples in this respect. The use of an absorber material in a liquid phase can offer advantages if complex geometries of the absorber element have to be realized.

In order to realize as high a level of absorption as possible of the energy of the high-voltage discharge-related transients, it is a benefit if the absorber element has a high damping factor for the transients occurring. In this case, both the material as well as the geometry of the absorber element are a factor. A toroid-like geometry of the absorber element, for example, has proved to be beneficial. Furthermore, ferritic materials, which can be produced in a configuration in which they have a high damping factor at high frequencies, which are typically 1 MHz and above in the present case, have proved their worth also in this case.

It was found to be beneficial if the inductance of the absorber element is at least 1 μH and more particularly at least 10 μH. In an embodiment, the inductance can in this case be selected to be adapted to the frequencies of the transients observed in practice in order to ensure as high an absorption efficiency as possible.

In order to realize as high a level of absorption as possible of the energy of the high-voltage discharge-related transients, in an embodiment, moreover, if the absorber element encloses the inner conductor in a ring-shaped manner. In an embodiment, the ring is magnetically closed.

In another embodiment, the absorber element encases both the inner conductor as well as the insulator in a ring-shaped manner. Particularly, the insulator has a round cross section in whose center the inner conductor is disposed, and the absorber element encloses the insulator in a ring-shaped manner. This results in a particularly high absorption efficiency of the absorber element according to the invention if the gap width between the inner surface of the absorber element and the outer surface of the insulator is less than 1 mm, particularly less than 0.5 mm, and more particularly less than 0.1 mm. A press fit of the ring-shaped absorber on the outer surface of the insulator, which is, for example, cylindrical or even conical, if necessary, has also proved to be advantageous in an embodiment. In principle, however, greater gap widths than those mentioned above are also possible.

It was found to be beneficial to select the material properties of the absorber element (permeability, inductance) so as to be adapted to the specific geometry of the absorber element.

Within the context of the practical testing of the cable according to the invention, it was found that a particularly high efficiency of the absorber element is obtained if it is disposed between the inner conductor and the shielding.

An absorber element comprised of a casing of the insulator together with the interior inner conductor was also found to be beneficial in an embodiment. This casing comprises a material with a high permeability, e.g. iron. The casing is to be configured in such a way that the casing has a high damping factor for the discharge-related transients occurring on the inner conductor. To this end, it may be configured in such a way that it has an inductance in the range mentioned above. In an embodiment, the casing extends over a length of at least a few centimeters, however, substantially over the entire length of the cable. For example, the casing can be comprised of at least one wire, but also of several wires if necessary, which are wound onto the outer periphery of the insulator in a coil-like manner. More particularly, thin strips of a suitable material can also be used for winding instead of wires.

In an embodiment, a high-voltage resistant plug is also provided for connecting a high-voltage source with the acceleration section of an X-ray tube, in particular an open microfocus X-ray tube. The plug has a, if necessary multi-core, inner conductor surrounded by an electrical insulator. The insulator is a puncture-proof dielectric, with the use of EPR having proved its worth.

Further, the plug has a shielding which envelops the inner conductor and the insulator over a certain length and is made of an electrically conductive material. In this case, the shielding can be configured as a metal sleeve, for example, which is pushed on to the outer surface of the insulator. Such a metal sleeve can be integrally connected to an attachment flange for attachment to a complementarily configured socket or a device housing, or a separately formed attachment flange can be mechanically connected to the metal sleeve in a suitable manner, e.g. by means of screwing. In particular, the shielding can be provided to be mechanically and electrically conductively connected to the electrically conductive shielding of a cable, whose inner conductor is connected in an electrically conductive manner to the inner conductor of the plug.

According to the invention, it is now provided that the plug further comprises an absorber element suitable for absorbing the energy of high-voltage discharge-related transients.

Also in this case, it was found that an absorber element with damping properties can be fabricated from a soft magnetic material. The properties of such an absorber element are particular with regard to the problem to be solved according to the invention if the permeability of the soft magnetic material is above 50, particularly above 500, and more particularly above 1000.

In particular, iron in a ferromagnetic crystal structure, cobalt, alloys comprising the constituents nickel and iron, ferritic materials, amorphous metals, nanocrystalline metals and ferrofluids have again proved to be suitable soft magnetic materials. Generally, the soft magnetic material used for the absorber element will be present in a solid phase; however, the use of a material which is present in a liquid/fluid phase is also possible. Ferrofluids are mentioned as examples in this respect. The use of an absorber material in a liquid phase can offer advantages if complex geometries of the absorber element have to be realized.

In order to realize as high a level of absorption as possible of the energy of the high-voltage discharge-related transients, it is beneficial if the absorber element encloses the inner conductor in a ring-shaped manner. In an embodiment, the absorber element encases both the inner conductor as well as the insulator in a ring-shaped manner. Particularly, the insulator has a round cross section in whose center the inner conductor is disposed, and the absorber element encloses the insulator in a ring-shaped manner. This results in a particularly high absorption efficiency of the absorber element according to the invention if the gap width between the inner surface of the absorber element and the outer surface of the insulator is less than 1 mm, particularly less than 0.5 mm, and more particularly less than 0.1 mm. A press fit of the ring-shaped absorber on the outer surface of the insulator, which is, for example, cylindrical or even conical, if necessary, has also proved to be particular.

Within the context of the practical testing of the plug according to the invention, it was again found that a particularly high efficiency of the absorber element is obtained if it is disposed between the inner conductor and the shielding.

In an embodiment, a high-voltage resistant socket is also provided for connecting a high-voltage source with the acceleration section of an X-ray tube, in particular an open microfocus X-ray tube. The socket has a, if necessary multi-core, inner conductor surrounded by an electrical insulator. The insulator is a puncture-proof dielectric, with the use of EPR having proved its worth. In particular, the insulator can in this case have a cylindrical, if necessary conical, inner recess, at whose end the inner conductor is disposed, for accommodating a complementary plug.

Further, the socket has a shielding which envelops at least the insulator, but if necessary also the inner conductor, over a certain length and which is made of an electrically conductive material. In this case, the shielding can be configured as a metal sleeve, for example, which is pushed on to the outer surface of the insulator. Such a metal sleeve can be integrally connected to an attachment flange for attachment to a complementarily configured plug and/or to a device housing, or a separately formed attachment flange can be mechanically connected to the metal sleeve in a suitable manner, e.g. by means of screwing. In particular, the shielding can be provided to be mechanically and electrically conductively connected to a device housing that is configured to be electrically conductive.

According to the invention, it is now provided that the socket further comprises an absorber element suitable for absorbing the energy of high-voltage discharge-related transients.

It was again found that an absorber element with damping properties can be fabricated from a soft magnetic material. The properties of such an absorber element are particular with regard to the problem to be solved according to the invention if the permeability of the soft magnetic material is above 50, particularly above 500, and more particularly above 1000.

In particular, iron in a ferromagnetic crystal structure, cobalt, alloys comprising the constituents nickel and iron, ferritic materials, amorphous metals, nanocrystalline metals and ferrofluids have again proved to be suitable soft magnetic materials. Generally, the soft magnetic material used for the absorber element will be present in a solid phase; however, the use of a material which is present in a liquid/fluid phase is also possible. Ferrofluids are mentioned as examples in this respect. The use of an absorber material in a liquid phase can offer advantages if complex geometries of the absorber element have to be realized.

In order to realize as high a level of absorption as possible of the energy of the high-voltage discharge-related transients, it is particular if the absorber element encloses the inner conductor in a ring-shaped manner, or if its is disposed in such a way that it encloses in a ring-shaped manner the inner conductor of a plug accommodated by the socket. In an embodiment, the absorber element encases both the inner conductor as well as the insulator in a ring-shaped manner. Particularly, the insulator has a round cross section in whose center the inner conductor is disposed, and the absorber element encloses the insulator in a ring-shaped manner. This results in a particularly high absorption efficiency of the absorber element according to the invention if the gap width between the inner surface of the absorber element and the outer surface of the insulator is less than 1 mm, particularly less than 0.5 mm, and more particularly less than 0.1 mm. A press fit of the ring-shaped absorber on the outer surface of the insulator, which is, for example, cylindrical or even conical, if necessary, has also proved to be particular.

Within the context of the practical testing of the socket according to the invention, it was found that a particularly high efficiency of the absorber element is obtained if it is disposed between the inner conductor and the shielding, wherein an electrically conductive housing that is connected to the shielding of the socket in an electrically conductive manner is also to be considered to be a shielding in this context.

With regard to the selection of the material and geometry of the absorber element for a socket according to the invention or a plug according to the invention, reference is made to the statements pertaining thereto in connection with the cable according to the invention.

Further, the subject matter of an embodiment of the present invention is a high-voltage resistant plug-and-socket combination having a high level of damping for high-voltage discharge-related transients, with this plug-and-socket combination being provided for forming an electrical plug-and-socket connection of a high-voltage source to the acceleration section of an X-ray tube. In this case, the high-voltage resistant plug-and-socket combination comprises a plug or a socket or both.

The connecting cable further comprised by an embodiment of the present invention also has a high level of transient damping and is provided for forming an electrical plug-and-socket connection of a high-voltage source to the acceleration section of an X-ray tube. In this case, the HV connecting cable comprises a high-voltage resistant cable and a high-voltage resistant plug or a high-voltage resistant socket, wherein the high-voltage resistant cable can be a cable for the electrically conductive connection of a high-voltage source with the acceleration section of an X-ray tube, with an inner conductor, an electrical insulator surrounding the latter, and a shielding (62) made of an electrically conductive material and enveloping the inner conductor and the insulator, wherein the cable further comprises an absorber element for absorbing the energy of high-voltage discharge-related transients, the high-voltage resistant plug can be a plug for forming an electrical connection, e.g. a plug-and-socket connection, of a high-voltage source with the acceleration section of an X-ray tube, with an inner conductor, an electrical insulator surrounding the latter, and a shielding made of an electrically conductive material and enveloping the inner conductor and the insulator, wherein the plug further comprises an absorber element for absorbing the energy of high-voltage discharge-related transients and the high-voltage resistant socket can be a socket for forming an electrical connection, e.g. a plug-and-socket connection, of a high-voltage source with the acceleration section of an X-ray tube, with an inner conductor, an electrical insulator surrounding the latter, and a shielding made of an electrically conductive material that envelops at least the insulator, and preferably also the inner conductor, at least over a part of their longitudinal extent, wherein the socket further comprises an absorber element for absorbing the energy of high-voltage discharge-related transients, and wherein at least one of the aforementioned components is configured according to the aforementioned.

In practice, a very good transient damping is obtained, and thus an effective reduction of the danger of damage to the high-voltage cable and the high-voltage source, if a high-voltage resistant cable or a high-voltage resistant plug or a high-voltage resistant socket or a high-voltage resistant plug-and-socket combination or a high-voltage resistant connecting cable is used for connecting the high-voltage source to the acceleration section of the X-ray tube. Such a use makes it possible to dispense with the high-gloss polishing of the current-carrying parts of the X-ray tube, which requires much effort, because the high-voltage discharges occurring during the conditioning of the X-ray tube no longer have a damaging effect on the HV connecting cable and the high-voltage source. Protection is also sought for an assembly comprising an X-ray tube with an acceleration section and a high-voltage source, with an HV connecting cable for the electrically conductive connection of the high-voltage source and the acceleration section.

A method according to the invention for the reduction of flashover-related damage to an assembly comprising an X-ray tube with an acceleration section and a high-voltage source comprises a method step in which the acceleration section is electrically connected to the high-voltage source via a high-voltage resistant connecting cable.

It is pointed out that the features mentioned above as well as in the claims that relate to a cable according to the invention, a plug according to the invention, a socket according to the invention, a plug-and-socket combination according to the invention, an HV connecting cable according to the invention and an assembly according to the invention can each be used for further developing other subject matters according to the invention, even beyond the device and method categories, if necessary.

Other advantages and features of the present invention are apparent from the exemplary embodiment, which serves for illustrating the invention to the person skilled in the art and is not to be understood as limiting. The exemplary embodiment is explained in more detail with reference to a drawing. In the drawing:

DETAILED DESCRIPTION

Figure 1:
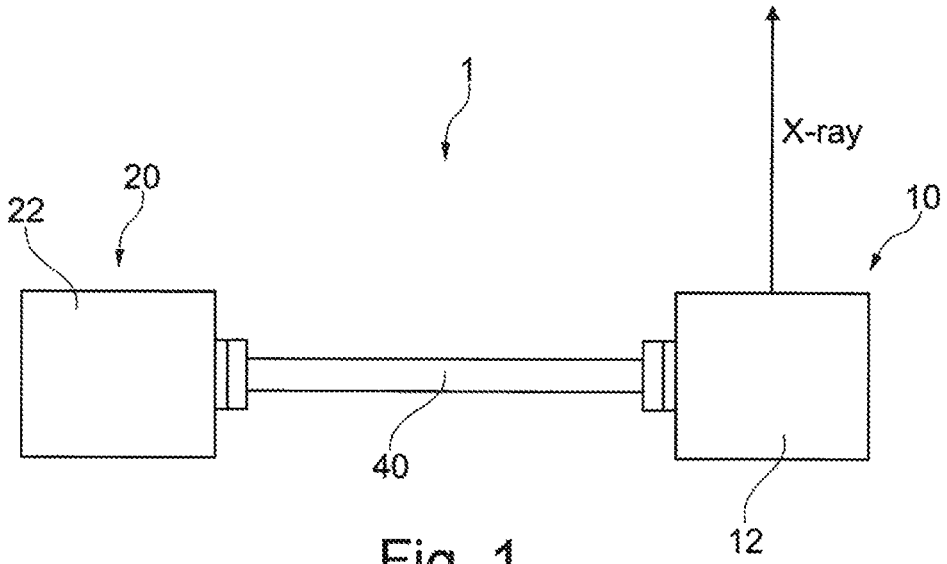
FIG. 1 shows a schematic representation of a testing assembly according to the invention for the non-destructive material testing by means of X-radiation.

FIG. 1 shows a testing assembly 1 for the non-destructive material testing by means of X-radiation. The assembly comprises a microfocus X-ray tube 10 with an acceleration section and a high-voltage source 20 formed separate from the X-ray tube. Further, the testing assembly 1 comprises a high-voltage resistant HV connecting cable 40 for electrically connecting the acceleration section with the high-voltage source.

Figure 2:
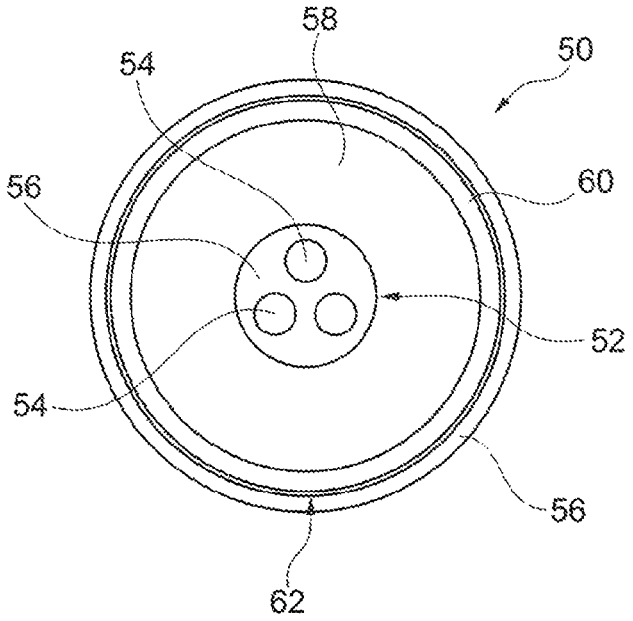
FIG. 2 shows a sectional view of a high-voltage resistant cable used for an HV connecting cable according to the invention.

The HV connecting cable 40 comprises a high-voltage resistant cable 50 according to FIG. 2 with an inner conductor 52, an electrical insulator 58 surrounding the latter, and a shielding 62 made of an electrically conductive material and enveloping the inner conductor 52 and the insulator 58.

The inner conductor 52 and the shielding 62 are made from an alloy of Cu and Sn, with the inner conductor 52 having a three-core configuration.

The three cores 54 of the inner conductor 52 are embedded in a sheath 56 made from semi-conductive ERP.

The sheath 56 itself is surrounded by an electrical insulator 58 with a round cross section made from non-conductive ERP. On its outer surface, the insulator 58 is covered with a thin sheath layer 60 made from semi-conductive ERP, on which the electrically conductive shielding 62 is, in turn, disposed. On the outer side, the assembly comprised of the inner conductor 52, the insulator 58 and the shielding 62 is wrapped in a cable sheath 64 of PVC.

Figure 3:
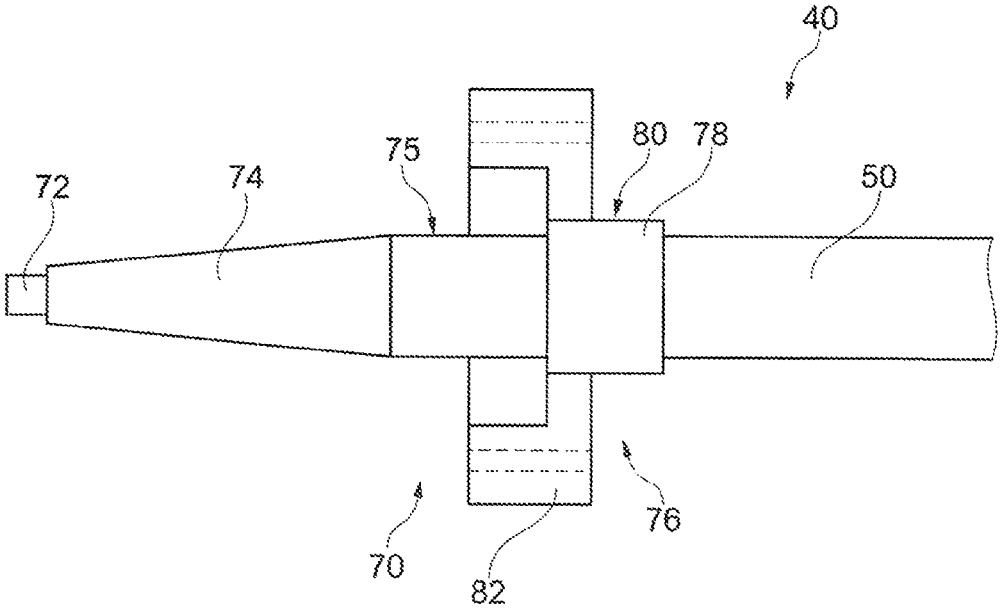
FIG. 3 shows a partial sectional view of a high-voltage resistant plug used for an HV connecting cable according to the invention.

On its two ends, the HV connecting cable 40 is provided with a high-voltage resistant plug 70 according to FIG. 3 for forming an electrical plug-and-socket connection of the high-voltage source 20 with the acceleration section of the X-ray tube 10. The plugs 70 also each comprise an inner conductor 72 which is made from an electrically conductive material, in particular a metallic material, which, if necessary, is surface-treated, and which is embedded in the center of an electrical insulator 74 with a round cross section that tapers towards the end of the plug on the side of the socket. The inner conductor 72 and the insulator 74 are encased over a part of their length by a shielding 76 made of a material that is also electrically conductive. In the exemplary embodiment shown, the shielding 76 is configured as a metallic sleeve 78 to whose outer surface 80 a flange part 82 is screwed. The flange part is configured for mechanically fixing the plug 70 in a complementarily formed high-voltage resistant socket 90 according to FIG. 4, e.g. by means of a screw connection with a corresponding flange part of the socket 90.

Figure 4:
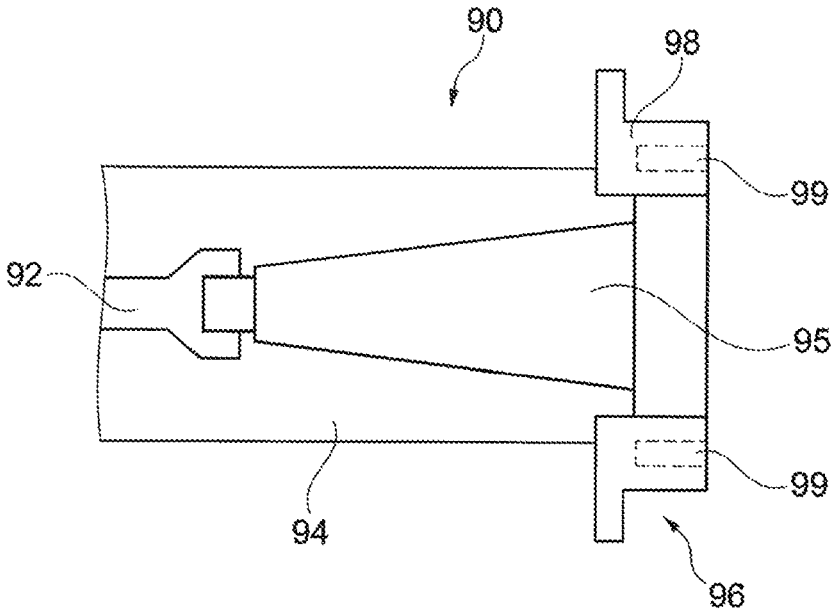
FIG. 4 shows a partial sectional view of a high-voltage resistant socket used for an HV connecting cable according to the invention.

The high-voltage resistant socket 90 according to FIG. 4 also has an inner conductor 92 and an electrical insulator 94 surrounding the latter, which forms a conical recess 95 for accommodating the conically tapering end 74 of the plug 70 in the exemplary embodiment shown. The shielding 96 of the socket 90 is formed as a metallic flange part 98, which, on the one hand, is made from an electrically conductive material, such as a metal sheet, for the purpose of being screw-connected to a surrounding housing, and, on the other hand, has threaded bores 99 that serve for a screw-connection to the flange part 82 of the plug 70. If necessary, the shielding can also comprise an electrically conductive layer, e.g. made from a copper-tin alloy, which is applied to the outside of the insulator 94 (not shown). Such an electrically conductive layer can be configured, for example, as a cylindrical socket housing in which the insulator 94 and the inner conductor 92 are disposed.

Figure 5:
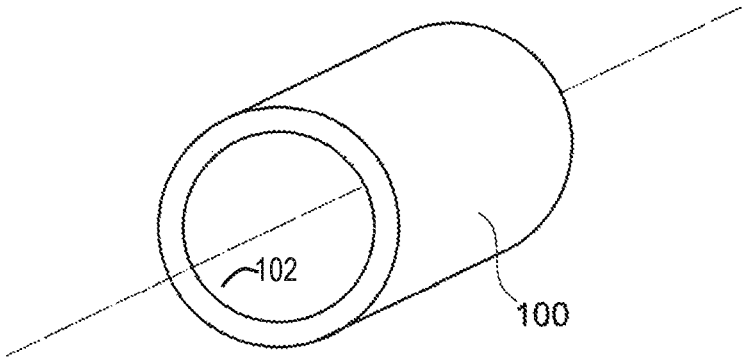
FIG. 5 shows a three-dimensional representation of a damping body according to the invention.

FIG. 5 shows an absorber element 100 for absorbing the energy of high-voltage discharge-related transients, which is configured to be pushed on to the conically tapering end of the plug 70 until this results in a press fit in the cylindrical portion 75 indicated in FIG. 3. The absorber element 100 has a ring-shaped geometry, with the diameter of the inner recess being adapted to the outer diameter of the cylindrical portion 75, so that a press fit of the absorber element 100 on the cylindrical portion 75 is obtained. In this position, the absorber element 100 encloses the inner conductor 72 of the plug 70 in a ring-shaped manner The inner diameter of the absorber element 100 is typically a few millimeters to a few tens of millimeters; the wall thickness of the ring is typically a few millimeters. The longitudinal extent of the ring along its axis of symmetry is also typically a few millimeters. Both the wall thickness as well as the longitudinal extent are primarily limited by the geometry of the plug-and-socket combination used. However, it was found that a larger volume of the absorber element 100 improves its efficiency according to the invention. Furthermore, it was found that the efficiency of the absorber element 100 is improved if the gap width between the cylindrical inner surface 102 of the absorber element 100 and the cylindrical outer surface 75 of the insulator 74 of the plug 70 is minimal. In the exemplary embodiment shown, the gap width is virtually zero, due to the press fit of the absorber element 100, and is determined substantially by the machining precision of the surfaces 102 and 75.

The absorber element 100 is made of a soft magnetic material whose permeability in an embodiment is above 500 and particularly above 1000. Iron in a ferromagnetic crystal structure and soft magnetic ferrites have proved to be particularly suitable materials that permit a cost-effective production of sufficiently efficient absorber elements 100. Manganese-zinc ferrites and nickel-zinc ferrites are suitable ferrites.

Figure 6:
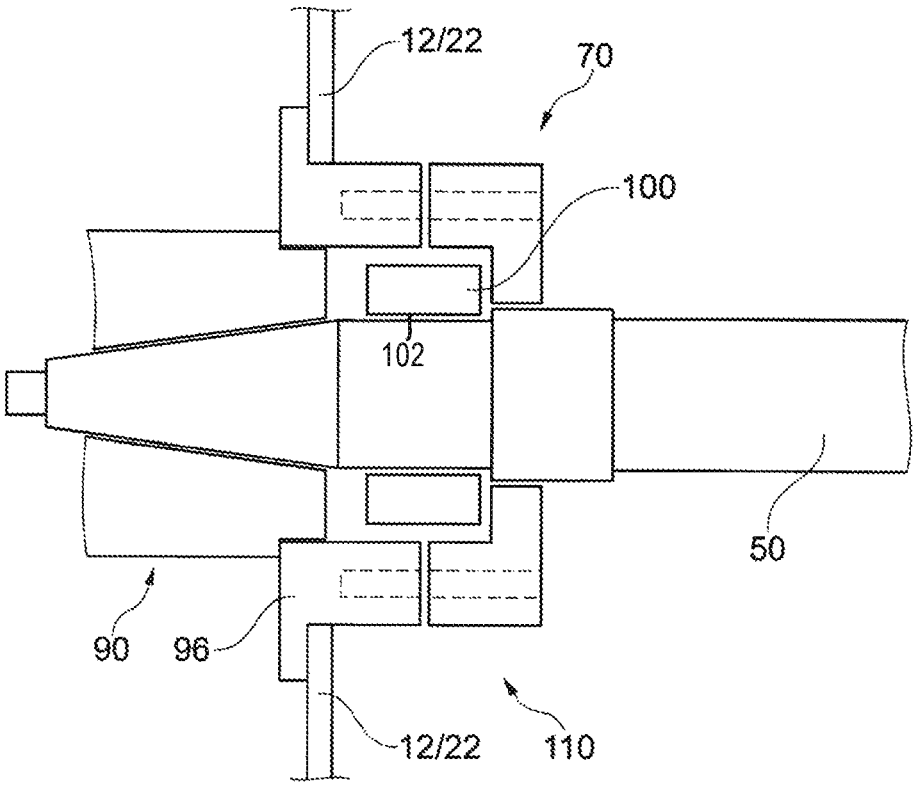
FIG. 6 shows a partial sectional view of a high-voltage resistant plug-and-socket combination used for an HV connecting cable according to the invention.

FIG. 6 shows a high-voltage resistant plug-and-socket assembly or combination 110 according to the invention, i.e. the plug 70 from FIG. 3 inserted into a socket 90, which in turn is screwed with its flange part 96 to the wall of a housing 12/22 of an X-ray tube 10 or a high-voltage source 20 while forming an electrically conductive connection.

Figure 7:
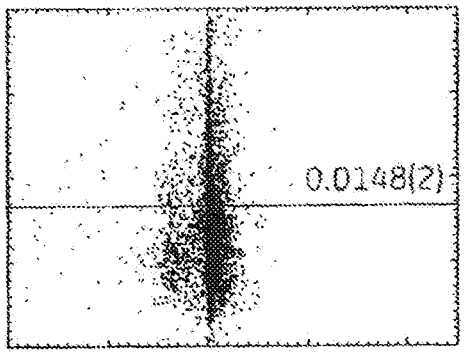
Fig. 7 PRIOR ART
FIG. 7 shows the frequency distribution of the flashovers observed during the assembly of a ventilated microfocus X-ray tube depending on the flashover voltage and the strength of the observed transient oscillations on the inner conductor of an HV connecting cable between the high-voltage source and the X-ray tube according to the prior art, FIG. 8 as FIG. 7, using an HV connecting cable according to the invention with a damping body made of ferromagnetic iron, FIG. 9 as FIG. 7, using an HV connecting cable according to the invention with a damping body made of a ferritic material.
Figure 8:
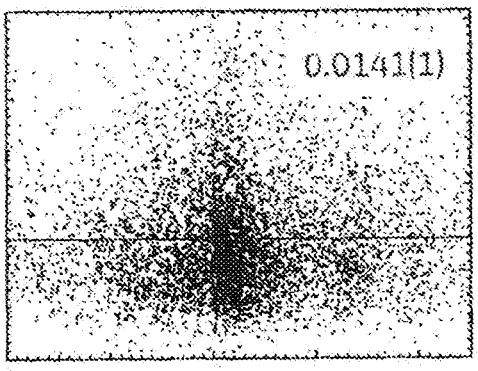
Figure 9:
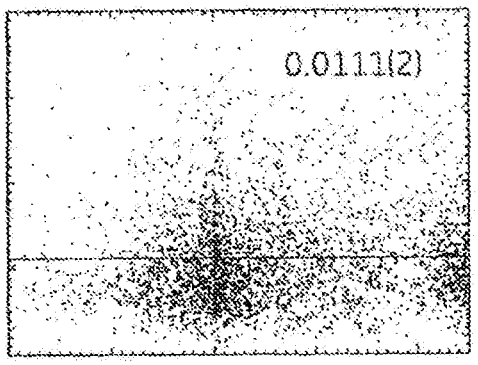

FIGS. 7, 8 and 9 each show the frequency distribution of the flashovers observed during the assembly of a ventilated microfocus X-ray tube depending on the flashover voltage and the power contained in the observed transient oscillations on the inner conductor of the HV cable between the high-voltage source and the X-ray tube. FIG. 7 shows the frequency distribution with an HV cable according to the prior art, FIG. 8 shows the frequency distribution with an HV cable according to the exemplary embodiment discussed above with an absorber element made of ferromagnetic iron, and FIG. 9 shows the frequency distribution with an HV cable according to the exemplary embodiment discussed above with an absorber element made of a ferritic material. The average strength of the oscillations can be reduced from a value of 0.0148(2) (arbitrary units) of the undamped system to a value of 0.0141(1) (arbitrary units) with the damping element of ferromagnetic iron and to a value of 0.0111(2) (arbitrary units) with the damping element of a ferritic material.

Figure 10:
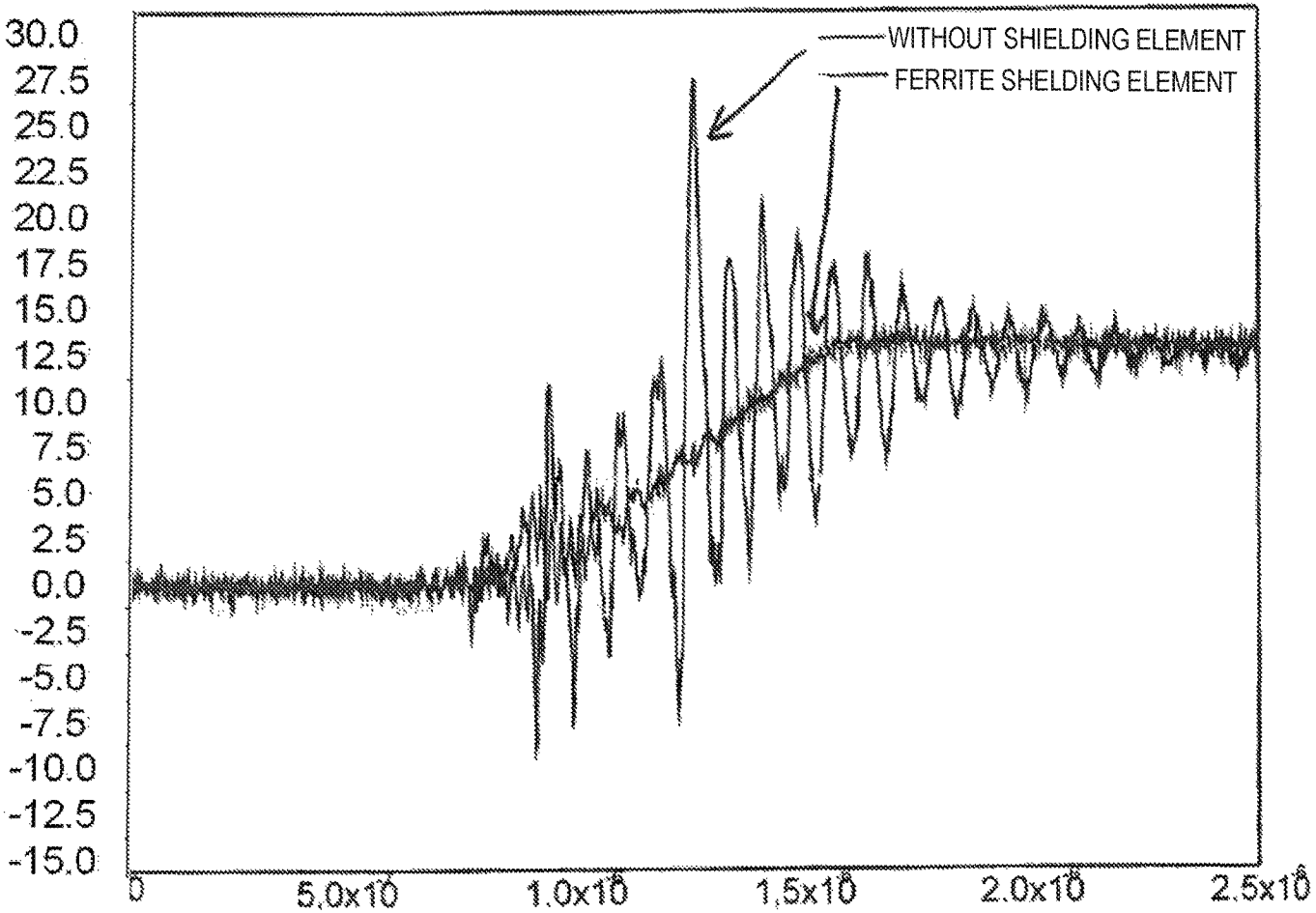
FIG. 10 shows the curve over time of the power in an HV connecting cable between a high-voltage source 20 and a microfocus X-ray tube 10 immediately after a flashover has occurred.

FIG. 10 shows the curve over time of the power in an HV connecting cable 40 between a high-voltage source 20 and a microfocus X-ray tube 10 immediately after a flashover has occurred. It shows the power curve in the case of the use of an undamped HV connecting cable 40 according to the prior art and an HV connecting cable 40 according to the exemplary embodiment discussed above. Just as in FIG. 9, a ferritic material was used as the material for the damping body 100. The strong transient damping obtained becomes apparent from FIG. 10, which is sufficient for reliably preventing damage both to the HV connecting cable 40 as well as the high-voltage source 20.

What is claimed is:

1. A high-voltage resistant cable for connecting a high-voltage source and an acceleration section of an X-ray tube, each of the high-voltage source and the acceleration section of the X-ray tube, having a respective socket and a respective flange that receive a respective end of the cable, the cable comprising:

an inner conductor;

an electrical insulator surrounding the inner conductor;

a shielding made of an electrically conductive material and enveloping the inner conductor and the insulator;

plugs at each of two respective ends of the cable for receipt at the respective sockets and the respective flanges of the high-voltage source and the acceleration section of the X-ray tube, each plug comprising:

a plug flange for cooperating with the respective flange, the plug flange having a hollow interior; and an electrical insulator insulating the inner conductor, the electrical insulator comprising a conic-shape portion for extending into the respective socket, and the electrical insulator comprising a cylindrical portion extending within the hollow interior of the plug flange; and absorber elements at each of the two ends of the cable for absorbing the energy of high-voltage discharge-related transients, each absorber element being configured as a ring-shape, the ring-shape absorber element encircling the cylindrical portion and being located within the hollow interior of the plug flange.

2. The cable according to claim 1 wherein the absorber elements are made of a soft magnetic material.

3. The cable according to claim 2, wherein permeability of the soft magnetic material is above 50.

4. The cable according to claim 3, wherein permeability of the soft magnetic material is above 500.

5. The cable according to claim 4, wherein permeability of the soft magnetic material is above 1000.

6. The cable according to claim 2, wherein the absorber elements are comprised of at least one of the following materials: iron, cobalt, alloys of NiFe, ferritic materials, amorphous metals, nanocrystalline metals and ferrofluids.

7. The cable according to claim 1, wherein the insulator has a round cross section in whose center the inner conductor is disposed, and the absorber elements enclose the insulator in a ring-shaped manner at each of the two ends of the cable.

8. The cable according to claim 7, wherein a gap width between an inner surface of the absorber element and an outer surface of the insulator is less than 1 mm.

9. The cable according to claim 8, wherein the gap width between the inner surface of the absorber element and the outer surface of the insulator is less than 0.5 mm.

10. The cable according to claim 9, wherein the gap width between the inner surface of the absorber element and the outer surface of the insulator is less than 0.1 mm.

11. The cable according to claim 1, wherein each absorber element encircling only the inner conductor and the electrical insulator of the respective plug.

12. The cable according to claim 1, further including a metal sleeve at each plug, each metal sleeve encircling the inner conductor and the electrical insulator of the respective plug.

13. The cable according to claim 12, wherein each metal sleeve encircling only the inner conductor and the electrical insulator of the respective plug.

14. The cable according to claim 1, wherein each absorber element is configured to be pushed on to the electrical insulator of the respective plug.

15. The cable according to claim 1, wherein each absorber element is press fit on to the electrical insulator of the respective plug.

16. The cable according to claim 15, wherein each absorber element is press fit on to the electrical insulator of the respective plug during connection of the respective plug to the respective socket.

17. The cable according to claim 16, wherein each absorber element is configured to be pushed on to the conic-shape portion of the electrical insulator.

18. The cable according to claim 1, wherein each absorber element is disposed between the inner conductor and the shielding.

* * * * *